US008956074B2

(12) United States Patent
Barrett

(10) Patent No.: US 8,956,074 B2
(45) Date of Patent: Feb. 17, 2015

(54) SYSTEM AND METHOD FOR REPAIR OF BRIDGE ABUTMENT AND CULVERT CONSTRUCTIONS

(71) Applicant: Robert K. Barrett, Boca Grande, FL (US)

(72) Inventor: Robert K. Barrett, Boca Grande, FL (US)

(73) Assignee: R & B Leasing, LLC, Grand Junction, CO (US)

( * ) Notice: Subject to any disclaimer, the term of this patent is extended or adjusted under 35 U.S.C. 154(b) by 0 days.

(21) Appl. No.: 13/864,949

(22) Filed: Apr. 17, 2013

(65) Prior Publication Data

US 2014/0310893 A1 Oct. 23, 2014

(51) Int. Cl.
*E01C 21/00* (2006.01)
*E02D 3/00* (2006.01)
*E02D 5/80* (2006.01)

(52) U.S. Cl.
CPC . *E01C 21/00* (2013.01); *E02D 3/00* (2013.01); *E02D 5/80* (2013.01)
USPC ..... 404/75; 404/27; 404/31; 405/259.1; 405/272; 405/284; 405/302.7

(58) Field of Classification Search
CPC ..... E02D 29/0233; E02D 17/20; E02D 3/00; E02D 5/80; E01C 21/00
USPC ..... 14/26, 74.5, 77.1, 78; 404/1, 27, 71, 31, 404/72–76; 405/262, 272, 284, 302.4, 405/302.7
See application file for complete search history.

(56) References Cited

U.S. PATENT DOCUMENTS

| | | | | |
|---|---|---|---|---|
| 373,295 | A * | 11/1887 | MacKnight | 404/30 |
| 5,395,185 | A * | 3/1995 | Schnabel, Jr. | 405/287 |
| 6,238,144 | B1 * | 5/2001 | Babcock | 405/284 |
| 6,874,975 | B2 * | 4/2005 | Hilfiker et al. | 405/262 |
| 6,890,127 | B1 | 5/2005 | Barrett et al. | |
| 7,125,202 | B2 * | 10/2006 | Morizot et al. | 405/262 |
| 7,377,725 | B2 * | 5/2008 | Cammack | 405/284 |
| 7,452,164 | B2 * | 11/2008 | Kim | 405/284 |
| 8,197,159 | B2 * | 6/2012 | Ridgway | 405/284 |
| 8,246,274 | B1 * | 8/2012 | Hall et al. | 405/262 |
| 8,448,279 | B2 * | 5/2013 | Cook | 14/77.1 |
| 8,562,259 | B2 * | 10/2013 | Ridgway et al. | 405/284 |
| 8,573,894 | B2 * | 11/2013 | Freitag et al. | 405/302.4 |
| 2005/0079017 | A1 * | 4/2005 | Morizot et al. | 405/285 |
| 2005/0271478 | A1 * | 12/2005 | Ferraiolo | 405/284 |
| 2008/0267718 | A1 * | 10/2008 | Costin | 405/262 |

* cited by examiner

*Primary Examiner* — Raymond W Addie
(74) *Attorney, Agent, or Firm* — Sheridan Ross P.C.

(57) ABSTRACT

A system and method provides for repair/reconstruction of bridge and culvert constructions. Geosynthetically confined soils are used in combination with soil nails. The soil nails provide additional tensile strength below the areas reinforced with the geosynthetically confined soils. The soil nails may include both horizontal and vertical soil nails. Various forms of vertical tensioning support can be provided to include soil nails, micro-piles, sheet piling, and the like. The confined soils are installed at locations under and adjacent to the man made constructions, and can be provided in both symmetrical and asymmetrical configurations. For bridge constructions, the confined soils may be installed at a desired depth under the bridge girders, and under other primary support members of the bridge. Horizontal nails may be installed under and adjacent to the confined soils. According to the method, incremental excavation can take place so that the manmade construction being repaired may remain partially open to accommodate public travel or other intended uses, thereby limiting the impact of the repair/reconstruction effort.

28 Claims, 5 Drawing Sheets

SYSTEM AND METHOD FOR REPAIR OF BRIDGE ABUTMENT AND CULVERT CONSTRUCTIONS

FIELD OF THE INVENTION

The invention relates generally to bridge and culvert constructions, and more particularly, to a system and method for repair and/or reconstruction of bridges and culverts including the use of geosynthetically confined soils in combination with soil nails and micro-piles.

BACKGROUND OF THE INVENTION

It is well known that constructions such as bridges and culverts eventually require some repair due to not only degradation or failure of components used for the bridges/culverts, but also due to degradation or failure of the abutments or other subsurface structures that support the constructions, such as retaining walls and the like. One aspect of the repair or construction that becomes particularly challenging for design engineers is that often, such repair or reconstruction requires the bridge/culvert to be closed while repairs are made. Particularly for those bridges/culverts that handle a significant level of traffic, the closure will negatively impact the surrounding road network, and can create significant hardships for businesses and/or homeowners that require access to the bridge for daily travel. Another problem that may create a significant design challenge for engineers is the inability to install a temporary bridge or bypass road during the repair or reconstruction effort. Often times, a bridge or culvert is located within an environmentally protected area, and it is not possible to obtain the necessary governmental authorizations in order to build a temporary bridge or bypass road. Yet another significant problem associated with repair or reconstruction of bridges/culverts is that traditional repair/reconstruction techniques may not only require complete disassembly of the superstructure, but also complete or significant reconstruction of the abutments or other support structures used for supporting the bridge/culvert.

One technique that has developed recently for erosion control of roadways is the use of soil nails. Soil nails can be used to add significant tensile strength to soil and soil/rock formations without having to completely excavate the area where the erosion occurred.

Is also known to use soil nails for slowing the rate of erosion or scour for moving bodies of water that pass under/through bridges and culverts. One example of a US patent reference that discloses the use of soil nails in this manner includes the U.S. Pat. No. 6,890,127. This reference more specifically discloses a scour platform to prevent scour of moving water, such as rivers or streams. The platform includes aggregate filled excavations that form a base or lower support for an overlying structure such as a bridge abutment. Soil nails can be placed along the bank of the body of water adjacent the scour platform.

While it may be known to provide various tensile inclusions such as soil nails and/or geosynthetic layers of sheet material for erosion control, there is still a need to provide a methodology for repair and/or reconstruction of bridges and culverts that departs from traditional design and construction techniques to alleviate the above identified problems associated with such repair/reconstruction. There is also a need to provide a methodology for repair/reconstruction of bridges and culverts in which the abutments and surrounding foundations/supports can be repaired without requiring complete excavation or replacement of such supports. There is also a need to provide a system and method for repair and reconstruction that is simple to execute, reliable, and conforms to various federal and state regulations regarding bridge/culvert constructions.

SUMMARY OF THE INVENTION

In accordance with the present invention, a system and method is provided for repair and/or reconstruction of bridge and culvert constructions. In one preferred embodiment of the system of the invention, the repair/reconstruction is achieved by incorporating geosynthetically confined soils in combination with soil nails. The soil nails provide additional tensile strength to the surrounding earth located below the areas that have been reinforced with the geosynthetically confined soils. The term "geosynthetically confined soils", or hereinafter "confined soils", may be generally defined as a stabilized earth construction including multiple sheets of woven or non-woven geosynthetic material arranged in layers with compacted, granular soil placed between the layers. The sheet material may be made from polypropylene or other known thermoplastic or plastic materials. In addition to use of sheet material, other substitutes can be used to achieve mechanical stabilization of the earth, such as use of steel mesh and geogrid materials. The term "abutment" is intended to cover all types of substructures at the end of a bridge span or columns of a bridge span, as well as all other types of substructures that may be incorporated below the superstructure of a bridge or culvert to support the upper superstructure, such as a roadway, railway, or other manmade structures. Accordingly, the term "abutment" is also intended to cover all related subsurface supports for bridges and culverts, such as foundations, retaining walls, and the like.

In one preferred embodiment, the repair/reconstruction of a bridge or culvert construction (hereinafter collectively a "construction") includes the use of confined soils that replace existing soil within or adjacent to an abutment. The confined soils are installed at a selected depth below the existing surface of the construction, but are not required to replace the entire soil or rock formation within or adjacent to the abutment. In order to further stabilize the earth/rock below the confined soils, soil nails are incorporated within a desired number and spacing to achieve the necessary tensioning support. More specifically, the soil nails are located at an elevation lower than the confined soils, and the soil nails are emplaced to extend in a direction substantially parallel with the span of the overhead structure such as a bridge or road, and further in which the soil nails extend with a defined horizontal component so that the nails can lie below the overlying confined soils. The soil nails can be emplaced by drilling in which holes are drilled through the exposed walls of the abutment and/or through sub-surface portions of the abutment walls. For this configuration of soil nails, they may be referred to herein as "horizontal" nails, since they have at least some obvious horizontal orientation, as opposed to being oriented substantially vertical.

In another preferred embodiment, the repair/reconstruction of the construction includes confined soils and the soil nails, and further includes micro-piles emplaced adjacent the abutment walls, and/or emplaced along other locations within the base of the abutment. These micro-piles provide additional tensioning support to the abutment and also help to prevent scour for those abutments without concrete bases. Scour is caused by a moving body of water through the abutment. These micro-piles can be of a larger diameter as compared to the horizontal soil nails, but the micro-piles may also include traditional soil nails. One acceptable material for use as micro-piles may include sheet piling. The micro-piles may also be alternatively referred to herein as "vertical" nails, the intention being that the micro-piles/vertical nails signify support as being installed in a substantially vertical orientation.

Because the damage to be repaired for each construction project will not be consistent, the present invention contemplates various combinations of the embodiments to be used in order to address the particular repair/reconstruction required. For example, one end or side of a construction may be undamaged, while the other end may be significantly damaged, thereby requiring repair/reconstruction. Accordingly, it may be only necessary to provide minimal additional support to the undamaged side of the construction (such as to supplement existing support with an array of soil nails). However, the other damaged side of the construction may require confined soils, horizontal nails, and vertical nails.

In yet another aspect of the invention, additional sets of soil nails may be employed to further strengthen the areas at or around the locations where confined soils are installed. For example, despite the significant strength that confined soils may provide, it may be necessary to provide yet additional support to the construction, such as around the periphery of the confined soils that may be near sloping grades, or other areas that are particularly susceptible to erosion. These additional sets of soil nails may more specifically be placed around the periphery of the confined soils.

According to a method of the present invention, the repair/reconstruction of a construction is provided through selected combinations of confined soils, horizontal nails, and micro-piles/vertical nails. The repair/reconstruction is achieved without having to completely rebuild the abutment, thus saving significant time and resources for completing the repair/reconstruction. In one aspect of this method, it is contemplated that at least one lane of a roadway over the abutment can remain open while the necessary repairs are made. According to this aspect, only a selected width of the superstructure is removed and repairs are made to the underlying area, while the remaining portion of the superstructure remains open for use. Once repairs are completed on one side, the roadway is reopened on the repaired side, and the opposite un-repaired side then undergoes the necessary repairs.

Various methods may be employed to improve the pullout capacity of the soil nails, to include filling the holes with cementitious material such as grout, or variations thereof, around the soil nails. In most cases, the soil nails are emplaced by drilling in which sufficiently large holes are formed to receive the soil nails along with an amount of grout. Another method to improve pullout capacity includes the use of specially constructed soil nails with exterior protrusions/features that increase the exterior surface area of the nails, resulting in generating increased frictional resistance with the surrounding soil.

In accordance with the above-described features of the invention, it may therefore be considered, in one aspect, a system for repair or reconstruction of a subsurface support of an overlying manmade construction, said subsurface support including an abutment with at least one wall, said system comprising: (i) geosynthetically confined soils installed within an excavated area adjacent to the subsurface support; and (ii) a plurality of first soil nails emplaced through the at least one wall, and below the geosynthetically confined soils, said first soil nails being employed at an angle, including a horizontal component.

In yet another aspect of the invention, it may also be considered a method of constructing a system for repair or reconstruction of a subsurface support of an overlying manmade construction, said subsurface support including an abutment with at least one wall, said method comprising: (i) installing geosynthetically confined soils within an excavated area adjacent to the subsurface support; and (ii) emplacing a plurality of first soil nails through the at least one wall and below the geosynthetically confined soils, said first soil nails being employed at an angle, including a horizontal component.

In yet a further aspect of the invention in accordance with both the system and method, it may also include providing a plurality of second soil nails emplaced through a base of the abutment, said plurality of second soil nails being employed substantially vertically.

In yet a further aspect of the invention in accordance with both the system and method, the geosynthetically confined soils are defined to include a plurality of layers of sheet material stacked on one another to create a vertical profile, including the plurality of layers and aggregate and/or soil filling gaps between the layers.

In yet a further aspect of the invention, it may be considered a combination of a manmade structure such as a bridge supported with abutments, and a system for repair or reconstruction of the abutments.

Other features and advantages of the invention will become apparent by a review of the following detailed description, taken in conjunction with a review of the accompanying drawings.

It shall be understood that the figures are intended to illustrate the structural components of the invention, and the components and surrounding environment may not necessarily be drawn to scale in order that the illustrations of the invention may be more readily understood. Further, the particular spacing and orientation between structural components of the invention may not necessarily be drawn to scale, also for purposes of better illustrating features of the invention.

DETAILED DESCRIPTION

Figure 1:
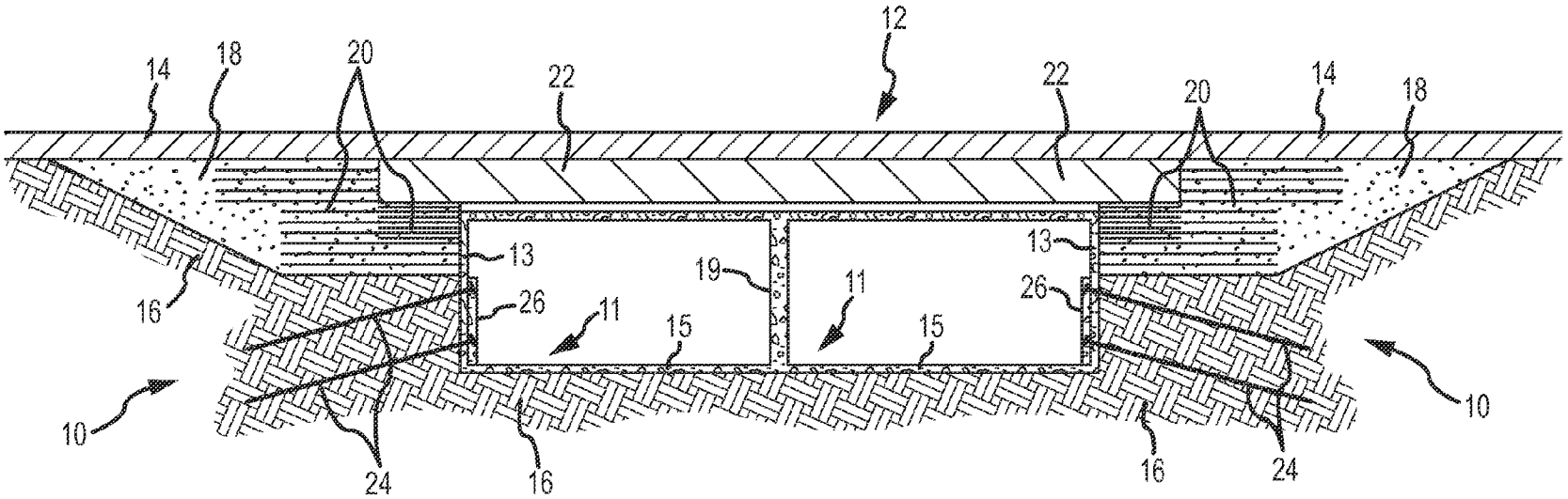
FIG. 1 is a cross-sectional elevation illustrating a first embodiment of the system of the invention.

Referring to FIG. 1, a system 10 of the invention is shown in the form of features used to repair or reconstruct subsurface supports for a manmade construction, such as a bridge or culvert. In the example of FIG. 1, a box culvert 11 is illustrated along with an overlying construction, such as a bridge construction 12. The culvert 11 includes sidewalls 13 and a base 15 that may be constructed of, for example, poured concrete. The culvert 11 may further include intermediate supports, such as one or more columns 19. FIG. 1 is further intended to represent a subsurface support in which the sidewalls 13 of the culvert serve the same purposes in terms of supporting an overhead structure. Thus as previously mentioned, the culvert 11 can also be generically described herein as an abutment. It is also intended that FIG. 1 illustrate a generic construction for a bridge that overlies the abutment.

Accordingly, the bridge 12 includes a plurality of bridge girders or beams 22. A road surface 14 overlies the bridge beams 22.

FIG. 1 more particularly illustrates a first embodiment of the system of the invention. Both ends of the construction have been repaired to include confined soils 20. The confined soils include layers of sheets of geosynthetic material with compacted fill placed between each sheet. In order to emplace the sheets of material, the superstructure of the bridge is removed, and areas near the ends of the bridge are excavated, shown as excavated areas 18. According to the system, it is not necessary to completely excavate all of the earth 16 under and around the construction 12.

In one aspect of the system, the confined soils are installed with predetermined depths within the excavated areas 18, and may also include confined soils 20 with different densities in terms of the thickness of aggregate/fill placed between layers of the sheet material. As shown in FIG. 1, areas directly underneath the ends of the beams 22 may include confined soils 20 with more closely spaced geosynthetic layers in order to provide greater support directly underneath the beams 22 at those locations. The other areas that incorporate confined soils 20 may include layers of the sheet materials with aggregate/fill provided at greater depths between the layers.

Figure 3:
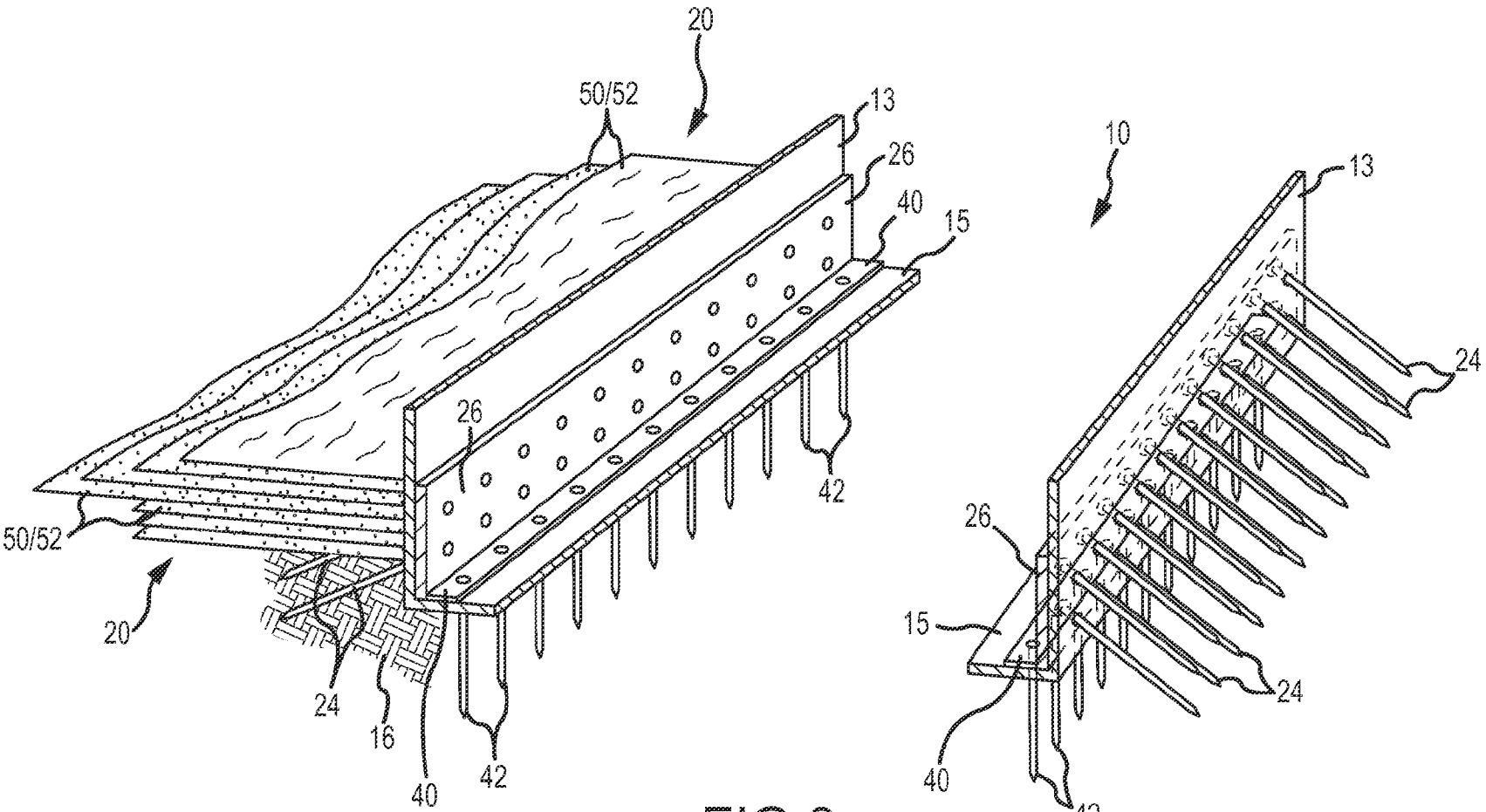
FIG. 3 is a fragmentary perspective view illustrating the second embodiment.

As also shown in the embodiment of FIG. 1, a plurality of horizontal nails 24 are emplaced, such that the nails are located generally in the areas under the confined soils 20. Also, referring to FIG. 3, one may better visualize the spacing of the horizontal soil nails in terms of their angled horizontal orientation, and spacing between nails. In the example of FIG. 3, the nails 24 are illustrated as being spaced continuously across a width of the culvert 11, it being understood that a selected number and type of horizontal soil nails may be used in order to provide the required support for the abutment repair/reconstruction. The horizontal nails 24 can be, for example, 12-14 feet in length. The angle of the horizontal nails can be approximately 15° downward, which enables grout placed within the holes receiving the nails to easily remain within the holes.

In order to install the horizontal soil nails 24, holes are drilled through the culvert sidewalls 13 and into the surrounding earth 16 to a desired depth. After the holes are drilled, soil nails are placed within the drilled holes. The pullout capacity of the horizontal soil nails 24 may be increased by filling the holes with grout, compacting soil around the nails, providing specially constructed soils with roughened exterior surfaces for increased exposed surface areas, and combinations thereof. The protruding ends of the nails 24 may be covered with a protective plate or panel 26, which may be a precast concrete panel, or may be a concrete panel that is cast in place over the exposed ends of the nails 24.

Figure 2:
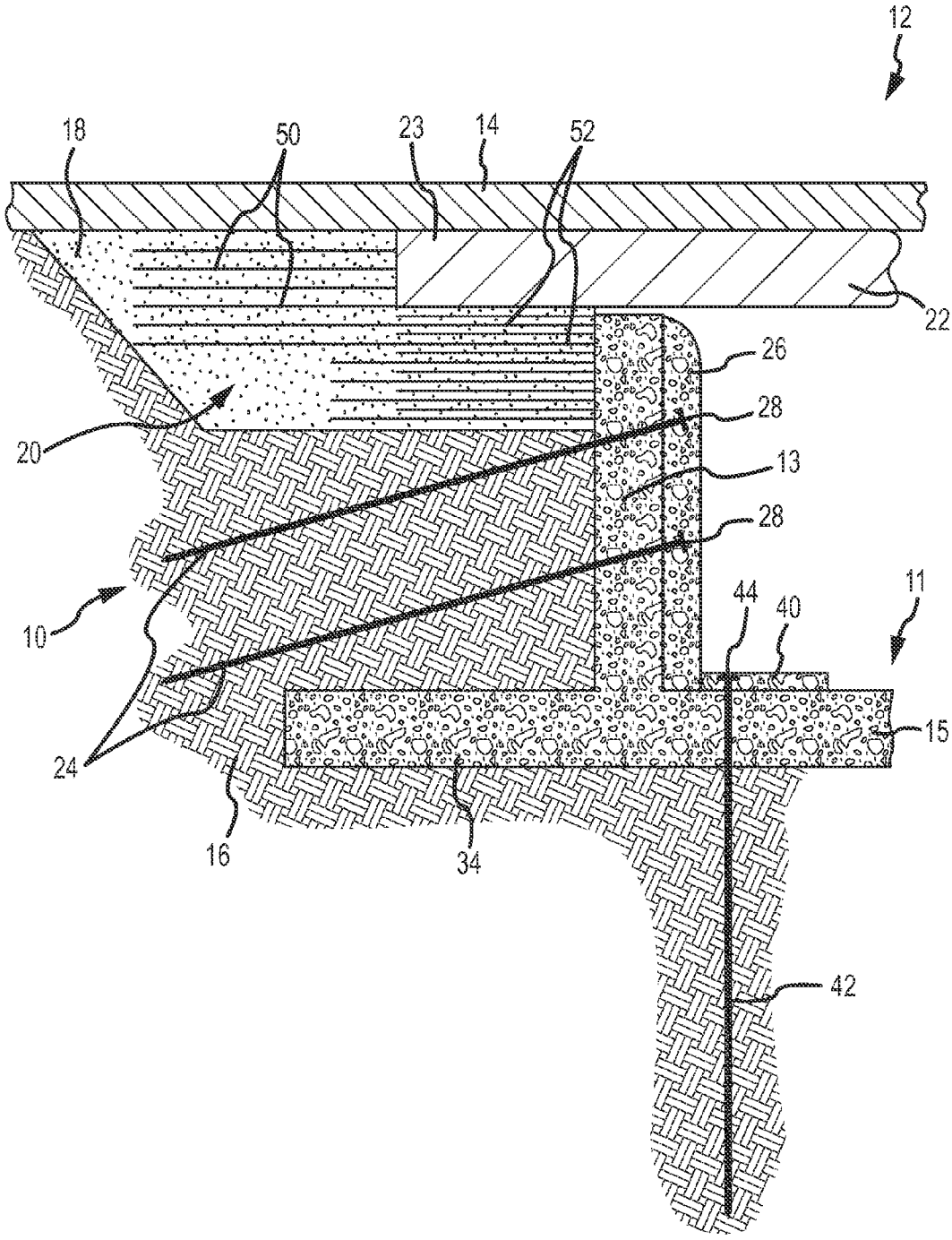
FIG. 2 is an enlarged fragmentary cross-sectional elevation illustrating a second embodiment of the system of the invention.

Referring to FIGS. 2 and 3, a second embodiment of the invention is illustrated that further includes the use of micro-piles or vertical nails 42. As shown, the micro-piles 42 are located adjacent the sidewall 13, and pass through the base 15 of the culvert 11 into the earth 16. FIG. 2 also illustrates the culvert 11 having an additional horizontal extension 34; however, it shall be understood that the invention is not limited to any particular construction details for the culvert 11. The protruding ends 44 of the nails 42 may be covered by a base panel or plate 40, which may be constructed similar to the protective plate 26 (pre-cast or cast in place concrete). As also shown in this figure, the protruding ends 28 of the horizontal nails 24 are shown as covered or embedded within the protective face plate/panel 26. The thickness of the panel 26 and base panel 40 should be a minimum that covers the exposed ends of the nails and in any event, a thickness of 4 inches or more for the plates can also provide additional structural support to the walls and base of the abutment/culvert support. The vertical nails 42 may also be 12-14 foot nails, but it should be understood that in some cases, additional or greater vertical tensioning support may be necessary for some constructions. Therefore, in the event that micro-piles 42 are used, they may extend up to 20 feet or more below the base of the culvert/abutment.

FIGS. 2 and 3 also illustrate the selective vertical spacing that may be achieved between the layers of the confined soil 20. More specifically, two groups or sets of confined soils are shown. The first group or set of layers of sheet material 50 is located beyond the end 23 of the beam 22 and surround the lateral sides of the bridge construction 12. The second group or set of layers of sheet material 52 are located directly under the ends 23 of the beams 22, and the layers of material are spaced more closely to one another. The gaps between the layers of sheet material can be selectively varied in order to provide the required support for an overlying element, such as the bridge beams 22. In general, more closely spaced sheet materials provide a stiffer support. However, the support capability of the confined soils is also a function of the specified gradation for the aggregate/backfill used between the layers of sheet material. The gradation for the confined soils may be specified for each project in order to meet requirements for handling the necessary repair/reconstruction. One example of selected spacing for the first group 50 could be 8 inches between sheets of geosynthetic material. One example for selected spacing for the second group 52 could be 4 inches between sheets of geosynthetic material.

One general design parameter that can be incorporated with respect to use of the confined soils is providing a lateral or horizontal extension of the confined soils that extends at least a ratio of 0.70 with respect to a height of the subsurface support. For example, if the culvert is 10 feet high as measured from the base 15 to the top of the culvert sidewall 13, the confined soils should extend at least 7 feet beyond the perimeter of the culvert. However, it shall be understood that this is but one general design parameter, and each project may dictate that the confined soils extend lesser or greater distances, depending upon such factors as the type of surrounding geology, and the location of the construction, among other factors.

Figure 4:
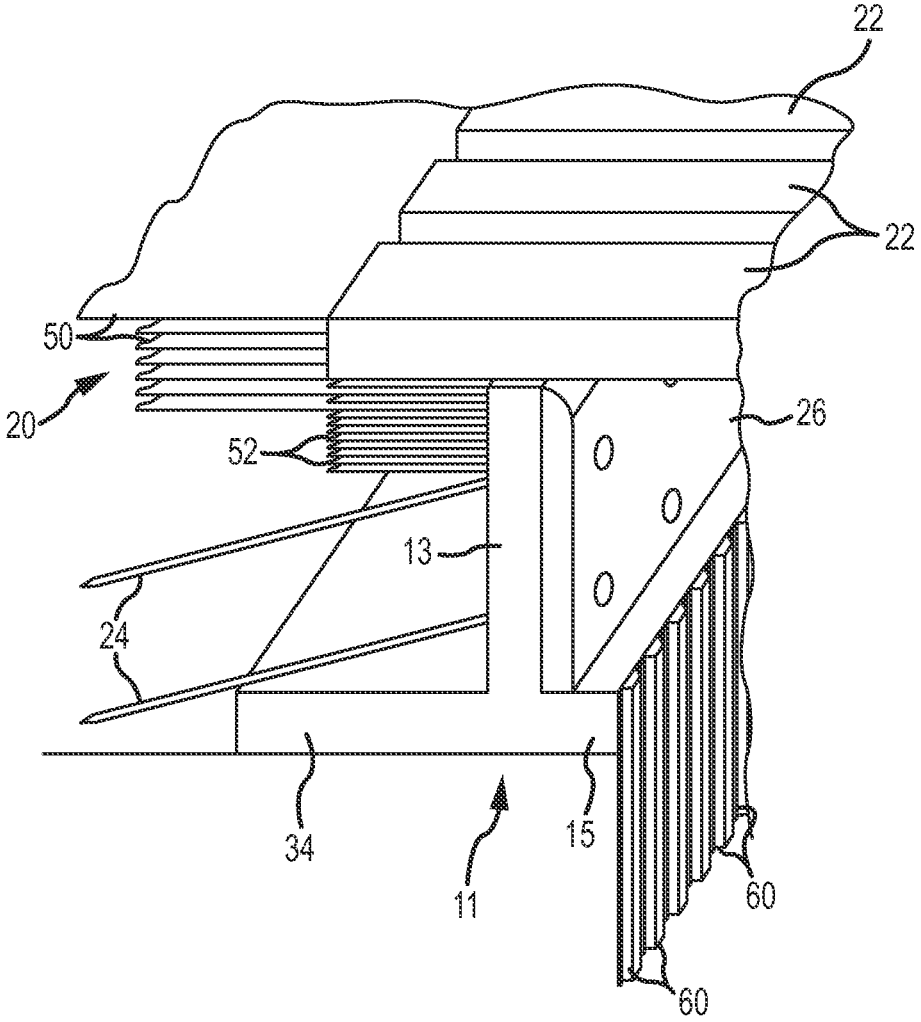
FIG. 4 is an enlarged fragmentary perspective view illustrating another aspect of the second embodiment.

Referring to FIG. 4, another aspect of the second embodiment is illustrated, namely, the use of sheet piling in the lieu of micro-piles 42. More specifically, a plurality of sheet piles 60 are arranged side-by-side, and then placed vertically into the earth as shown adjacent the culvert sidewall 13 and through the base 15. If the culvert includes the concrete base 15, a slot or channel is removed from the base to accommodate the sheet piling material. Although FIG. 4 illustrates the sheet piling members being closely spaced to one another, it is also contemplated that the sheet piling may be selectively spaced, such that it is only required to drill separate holes through the base 15 of the culvert in order to install the sheet piling. FIG. 4 also schematically illustrates the other components of the system, including the horizontal nails 24 and the two distinct sections of the confined soil 20, namely, sections 50 and 52 as previously described. The earth 16 and fill within the excavated area 18 has been removed in FIG. 4 in order to better illustrate the components of the system.

Figure 5:
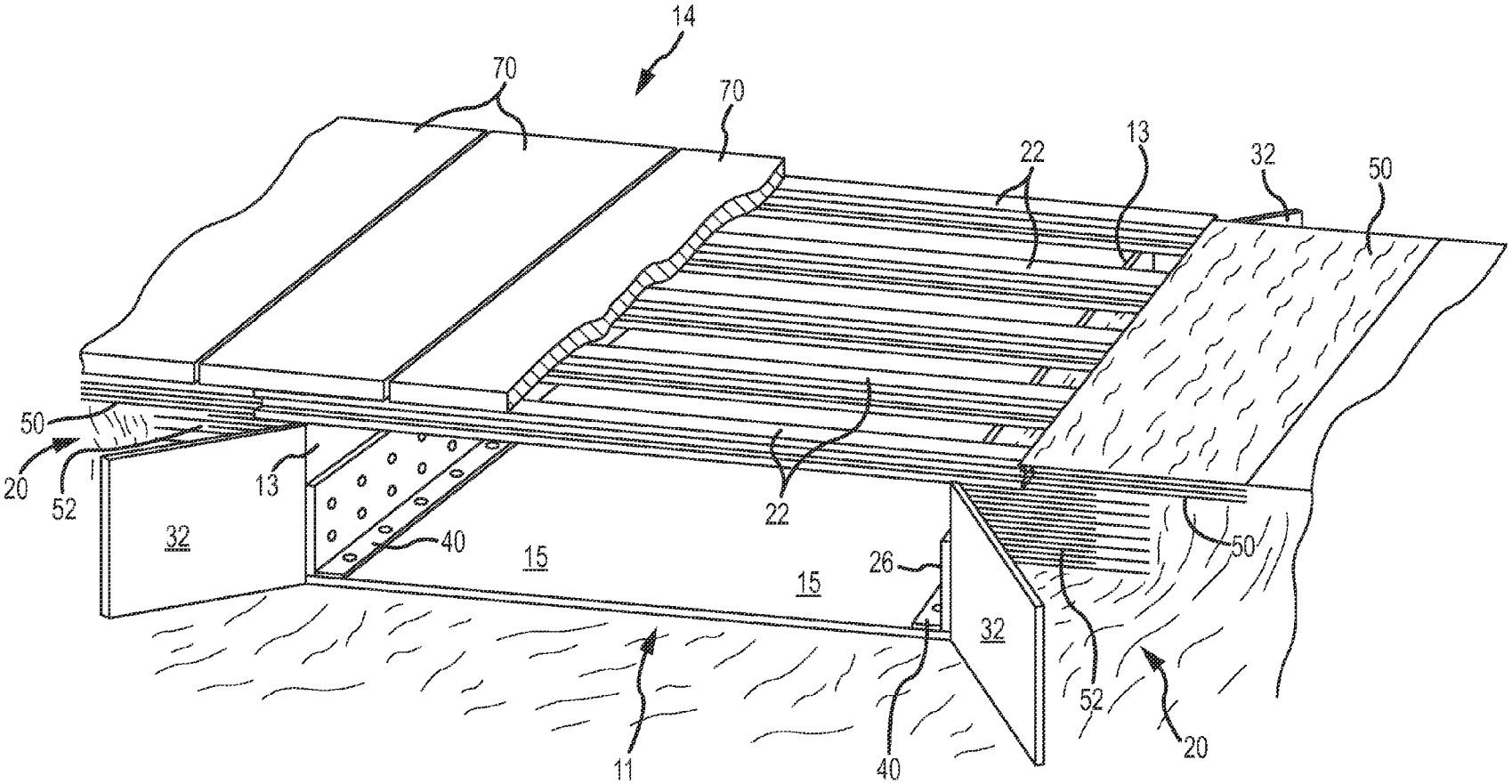
FIG. 5 is another perspective view illustrating a superstructure of a bridge or culvert construction, similar to that illustrated in FIG. 1, to further view features of the invention.

Referring to FIG. 5, another fragmentary perspective view is illustrated for purposes of showing details of the invention in a culvert construction. In this figure portions of the bridge superstructure are removed to further show the relationship of the bridge girders 22 over the confined soils 20. In the example of FIG. 5, the road 14 over the culvert 11 may include a plurality of precast concrete panels 70 as shown.

However, it shall be again understood that the particular construction for the bridge should not be deemed as limiting the present invention. This figure also illustrates the culvert 11 having wing walls 32, it began being understood that the particular construction of the culvert 11 should also not be deemed as limiting. The sheet material 50/52 is shown as exposed at the lateral sides of the system.

In accordance with a method of the present invention, repair/reconstruction of abutments is provided. According to the method, an evaluation is made to determine what specific repairs need to be made to the construction. If it is determined that additional support must be provided to the abutment, selected portions of the superstructure of the construction are removed, and the earth around the abutment is excavated to a desired depth. According to one aspect of the invention, only some of the earth at the abutment needs to be excavated, while some of the earth at or under the abutment may be kept in place. Confined soils are then installed in the excavated area. The selected number and configuration of sheets of geosynthetic materials are installed within the excavated area. The sheets of material may be provided in various sets that have differing spacing between sheets, and may have differing types of aggregate/fill between the layers of the sheet material.

According to another aspect in the method, horizontal nails are installed, and are generally located in areas below the excavated earth where the confined soils are located. For constructions with abutments having walls, holes may be drilled through the walls for installation of the soil nails. According to another aspect of the method, micro-piles or vertical nails may be installed also by drilling, in which holes are drilled through the base of the culvert or through the ground adjacent the walls of the abutment. A selected spacing is provided for both the horizontal nails and the micro-piles/vertical nails. In yet another aspect of the method, in lieu of micro-piles, sheet piling may be provided as the vertical tensioning elements. According to yet another aspect of the method, protective facings may be provided over the exposed ends of the horizontal and vertical nails/micro-piles by installation of corresponding faceplates and base plates. These faceplates and base plates may be precast or cast in place concrete panels that cover the exposed ends. These faceplates and base plates can also be selectively sized to provide additional structural support for the abutment or culvert structure being repaired.

There are numerous benefits and advantages to the system and method of present invention. The system may be installed incrementally for repair/reconstruction of a construction, and therefore the overlying structure such as a bridge does not have to be completely shut down. Another advantage to the present invention is that it does not require complete excavation of an existing subsurface support system, such as a culvert or abutment. Confined soils are placed within partial excavations of the abutment, and increased support is provided by soil nails that are selectively placed at locations below the excavations in which the confined soils are located. Because confined soils are used, the system and method of the present invention can be used within very different types of subsurface supports including abutment and culvert designs, since the confined soils may be installed in a countless number of configurations/orientations. More specifically, the sheet material can be cut in many different sizes and shapes; therefore, the sheets can be installed within both symmetrical and irregular shaped excavations.

While the invention incorporates some aspects of mechanically stabilized earth constructions, the invention provides additional benefits by use of vertical and horizontal soil nails that departs from traditional construction techniques that typically require complete excavations.

Although the foregoing invention has been described with respect to preferred embodiments for both a system and method, it shall be understood that various changes and modifications can be made to the invention commensurate with the scope of the claims appended hereto.

What is claimed is:

1. A system for repair or reconstruction of a subsurface support of an overlying manmade construction, said subsurface support including an abutment with at least one wall, said system comprising:

geosynthetically confined soils installed within an excavated area adjacent to the subsurface support;

a plurality of first soil nails emplaced through the at least one wall, and below the geosynthetically confined soils, said soil nails being employed at an angle, including a horizontal component;

said geosynthetically confined soils include at least two sections, each section having a different density defined by selected aggregate and/or soil that fills the gaps between the layers of sheet material, a first section of said at least two sections is located beneath said manmade construction, and a second section of said at least two sections is located adjacent to the first section, said geosynthetically confined soils having a lateral extension that extends at least a ratio of 0.70 with respect to a height of the subsurface support; and a plurality of second soil nails emplaced substantially vertically through a base of the abutment.

2. The system, as claimed in claim 1, wherein:

said plurality of first soil nails are emplaced through the at least one wall and spaced from one another laterally across a width of the abutment.

3. The system, as claimed in claim 1, wherein:

said plurality of first soil nails are emplaced through the at least one wall and spaced from one another laterally across a width of the abutment in two vertically spaced rows.

4. The system, as claimed in claim 1, wherein:

said plurality of second soil nails are emplaced through the base and spaced from one another laterally across a width of the abutment.

5. The system, as claimed in claim 1, wherein:

said geosynthetically confined soils include a plurality of layers of sheet material stacked on one another to create a vertical profile, including the plurality of layers and aggregate and/or soil filling gaps between the layers.

6. The system, as claimed in claim 1, wherein:

said first section of said at least two sections is located beneath primary support members of the manmade construction, said support members including beams, and said second section of said at least two sections is located adjacent to the first section.

7. The system, as claimed in claim 1, further including:

a base plate installed over the base of the abutment, and positioned to cover exposed ends of the plurality of second soil nails extending through the base.

8. The system, as claimed in claim 1, wherein:

said second soil nails include micro-piles.

9. The system, as claimed in claim 1, wherein:

said second soil nails include sheet piling.

10. A system for repair or reconstruction of a subsurface support of an overlying manmade construction, said subsurface support including an abutment with at least one wall, said system comprising:

geosynthetically confined soils installed within an excavated area adjacent to the subsurface support;

a plurality of first soil nails emplaced through the at least one wall, and below the geosynthetically confined soils, said soil nails being employed at an angle, including a horizontal component; and a face plate installed over the at least one wall of the abutment, and positioned to cover exposed ends of the plurality of first soil nails extending through the wall.

11. A method of constructing a system for repair or reconstruction of a subsurface support of an overlying manmade construction, said subsurface support including an abutment with at least one wall, said method comprising:

removing at least a portion of a superstructure of the manmade construction;

partially excavating an area adjacent the abutment in which an upper portion of earth adjacent the abutment is removed and a lower portion of earth remains;

installing geosynthetically confined soils within an excavated area adjacent to the subsurface support; and emplacing a plurality of first soil nails through the at least one wall, and below the geosynthetically confined soils into said lower portion of earth, said soil nails being employed at an angle, including a horizontal component.

12. The method, as claimed in claim 11, further including:

emplacing a plurality of second soil nails through a base of the abutment, said plurality of second soil nails being employed substantially vertically.

13. The method, as claimed in claim 11, wherein:

said plurality of first soil nails are emplaced through the at least one wall and spaced from one another laterally across a width of the abutment.

14. The method, as claimed in claim 11, wherein:

said plurality of first soil nails are emplaced through the at least one wall and spaced from one another laterally across a width of the abutment in two vertically spaced rows.

15. The method, as claimed in claim 12, wherein:

said plurality of second soil nails are emplaced through the base and spaced from one another laterally across a width of the abutment.

16. The method, as claimed in claim 11, wherein:

said geosynthetically confined soils include a plurality of layers of sheet material stacked on one another to create a vertical profile, including the plurality of layers and aggregate and/or soil filling gaps between the layers.

17. The method, as claimed in claim 11, wherein:

said geosynthetically confined soils are installed in at least two sections, each section having a different density defined by selected aggregate and/or soil that fills the gaps between the layers of sheet material.

18. The method, as claimed in claim 17, wherein:

a first section of said at least two sections is installed beneath primary support members of the manmade construction, said support members including beams, and a second section of said at least two sections is located adjacent to the first section.

19. The method, as claimed in claim 11, further including:

installing a face plate over the at least one wall of the abutment, and positioned to cover exposed ends of the plurality of first soil nails extending through the wall.

20. The method, as claimed in claim 11, further including:

emplacing a plurality of second soil nails through a base of the abutment, said plurality of second soil nails being employed substantially vertically, and said second soil nails being in the form of micro-piles.

21. The method, as claimed in claim 11, further including:

emplacing a plurality of second soil nails through a base of the abutment, said plurality of second soil nails being employed substantially vertically, and said second soil nails including sheet piling.

22. A method of constructing a system for repair or reconstruction of a subsurface support of an overlying manmade construction, said subsurface support including an abutment with at least one wall, said method comprising:

installing geosynthetically confined soils within an excavated area adjacent to the subsurface support; and emplacing a plurality of first soil nails through the at least one wall, and below the geosynthetically confined soils, said soil nails being employed at an angle, including a horizontal component;

emplacing a plurality of second soil nails through a base of the abutment, said plurality of second soil nails being employed substantially vertically; and installing a base plate over the base of the abutment and positioned to cover exposed ends of the plurality of second soil nails extending through the wall.

23. In combination, a system for repair or reconstruction of a subsurface support of an overlying manmade construction, said system comprising:

a subsurface support including an abutment with at least one wall;

geosynthetically confined soils installed within an excavated area adjacent to the subsurface support;

a plurality of first soil nails emplaced through the at least one wall, and below the geosynthetically confined soils, said plurality of first soil nails being employed at an angle, including a horizontal component;

a plurality of second soil nails emplaced through a base of the abutment, said plurality of second soil nails being employed substantially vertically; and said geosynthetically confined soils include a plurality of layers of sheet material stacked on one another to create a vertical profile, including the plurality of layers and aggregate and/or soil filling gaps between the layers, said geosynthetically confined soils include at least two sections, each section having a different density defined by selected aggregate and/or soil that fills the gaps between the layers of sheet material, a first section of said at least two sections is located beneath said manmade construction, and a second section of said at least two sections is located adjacent to the first section; and wherein said plurality of first soil nails are emplaced to extend in a direction substantially parallel with a span of the overlying manmade construction, and said plurality of first soil nails lie below said geosynthetically confined soils.

24. The combination, as claimed in claim 23, wherein:

said plurality of first soil nails are emplaced through the at least one wall and spaced from one another laterally across a width of the abutment.

25. The combination, as claimed in claim 23, wherein:

said plurality of first soil nails are emplaced through the at least one wall and spaced from one another laterally across a width of the abutment in two vertically spaced rows.

26. The combination, as claimed in claim 23, wherein:

said plurality of second soil nails are emplaced through the base and spaced from one another laterally across a width of the abutment.

27. The combination, as claimed in claim 23, wherein:

the abutment includes two abutments spaced from one another, and the manmade construction further includes a bridge mounted over the abutments, a first end of the bridge mounted over one abutment, and a second opposite end of the bridge mounted over the other abutment.

28. The combination, as claimed in claim 23, wherein:

said geosynthetically confined soils have a lateral extension that extends at least a ratio of 0.70 with respect to a height of said subsurface support.

* * * * *